US011726425B2

(12) United States Patent
Meguro

(10) Patent No.: US 11,726,425 B2
(45) Date of Patent: Aug. 15, 2023

(54) SHEET CONVEYING DEVICE AND IMAGE FORMING APPARATUS

(71) Applicant: Yuuji Meguro, Kanagawa (JP)

(72) Inventor: Yuuji Meguro, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 45 days.

(21) Appl. No.: 17/489,820

(22) Filed: Sep. 30, 2021

(65) Prior Publication Data

US 2022/0121146 A1 Apr. 21, 2022

(30) Foreign Application Priority Data

Oct. 19, 2020 (JP) ..... 2020-175568

(51) Int. Cl.

| | |
|---|---|
| ***G03G 15/16*** | (2006.01) |
| ***G03G 15/00*** | (2006.01) |
| ***B65H 43/00*** | (2006.01) |
| ***B65H 29/14*** | (2006.01) |

(52) U.S. Cl.

CPC ..... *G03G 15/6529* (2013.01); *B65H 29/14* (2013.01); *B65H 43/00* (2013.01); *B65H 2301/142* (2013.01); *B65H 2404/7414* (2013.01); *B65H 2601/255* (2013.01)

(58) Field of Classification Search

CPC ..... G03G 15/00; G03G 15/14–16; G03G 15/6529; G03G 21/00; B65H 29/14; B65H 43/00; B65H 2301/142; B65H 2404/7414; B65H 2601/255

See application file for complete search history.

(56) References Cited

U.S. PATENT DOCUMENTS

| | | | | |
|---|---|---|---|---|
| 6,394,447 | B1 * | 5/2002 | Kawai | B65H 15/004 271/186 |
| 2007/0110458 | A1 | 5/2007 | Inoue et al. | |
| 2007/0183816 | A1 | 8/2007 | Hatayama et al. | |
| 2007/0269233 | A1 | 11/2007 | Sakashita et al. | |
| 2008/0028967 | A1 | 2/2008 | Sakashita et al. | |
| 2008/0050158 | A1 | 2/2008 | Hatayama et al. | |
| 2008/0138133 | A1 | 6/2008 | Hatayama et al. | |
| 2008/0187365 | A1 | 8/2008 | Sakashita et al. | |
| 2008/0193167 | A1 | 8/2008 | Inoue et al. | |

(Continued)

FOREIGN PATENT DOCUMENTS

| | | |
|---|---|---|
| JP | 10-142950 | 5/1998 |
| JP | 10-282798 | 10/1998 |

(Continued)

*Primary Examiner* — Nguyen Q. Ha
(74) *Attorney, Agent, or Firm* — Xsensus LLP

(57) ABSTRACT

A sheet conveying device includes an abutment that abuts on a sheet conveyance path through which a sheet is conveyed. A holder supports the abutment and pivots to move the abutment between an abutting position where the abutment abuts on the sheet conveyance path and a retracted position where the abutment retracts from the sheet conveyance path. A biasing member applies a biasing force to the abutment. The biasing force moves the abutment from the retracted position toward the abutting position. A restrictor restricts motion of the abutment against the biasing force at the abutting position. An adjuster adjusts the biasing force applied to the abutment situated at the abutting position.

16 Claims, 6 Drawing Sheets

(56) References Cited

U.S. PATENT DOCUMENTS

| | | | |
|---|---|---|---|
| 2008/0193173 | A1 | 8/2008 | Meguro et al. |
| 2008/0226358 | A1 | 9/2008 | Hanashima et al. |
| 2008/0310893 | A1 | 12/2008 | Adachi et al. |
| 2008/0317521 | A1 | 12/2008 | Inoue et al. |
| 2009/0011882 | A1 | 1/2009 | Kichise et al. |
| 2009/0129831 | A1 | 5/2009 | Sakashita et al. |
| 2012/0057908 | A1 | 3/2012 | Meguro |
| 2012/0237268 | A1 | 9/2012 | Sakashita et al. |
| 2013/0011158 | A1 | 1/2013 | Meguro et al. |
| 2013/0051854 | A1 | 2/2013 | Sakuma et al. |
| 2014/0105655 | A1 | 4/2014 | Meguro |
| 2014/0147165 | A1 | 5/2014 | Sakuma et al. |
| 2015/0248099 | A1 | 9/2015 | Sakashita et al. |
| 2017/0139353 | A1 | 5/2017 | Sakashita et al. |
| 2017/0336729 | A1 | 11/2017 | Ohi et al. |
| 2018/0059595 | A1 | 3/2018 | Akiyama et al. |

FOREIGN PATENT DOCUMENTS

| | | | | |
|---|---|---|---|---|
| JP | 11-015288 | | 1/1999 | |
| JP | 2011-065063 | | 3/2011 | |
| JP | 2018128513 | A * | 8/2018 | ..... G03G 15/161 |

* cited by examiner

SHEET CONVEYING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-175568, filed on Oct. 19, 2020, in the Japan Patent Office, the entire disclosure of which is hereby incorporated by reference herein.

BACKGROUND

Technical Field

Exemplary aspects of the present disclosure relate to a sheet conveying device and an image forming apparatus, and more particularly, to a sheet conveying device for conveying a sheet and an image forming apparatus incorporating the sheet conveying device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium (e.g., a sheet) according to image data by electrophotography.

Such image forming apparatuses include a sheet conveying device that conveys a sheet through a sheet conveyance path. The sheet conveying device includes an abutment that abuts on the sheet conveyance path.

SUMMARY

This specification describes below an improved sheet conveying device. In one embodiment, the sheet conveying device includes an abutment that abuts on a sheet conveyance path through which a sheet is conveyed. A holder supports the abutment and pivots to move the abutment between an abutting position where the abutment abuts on the sheet conveyance path and a retracted position where the abutment retracts from the sheet conveyance path. A biasing member applies a biasing force to the abutment. The biasing force moves the abutment from the retracted position toward the abutting position. A restrictor restricts motion of the abutment against the biasing force at the abutting position. An adjuster adjusts the biasing force applied to the abutment situated at the abutting position.

This specification further describes an improved sheet conveying device. In one embodiment, the sheet conveying device includes an abutment that abuts on a sheet conveyance path through which a sheet is conveyed. A holder supports the abutment. A biasing member applies a biasing force to the abutment. The biasing force moves the abutment toward an abutting position where the abutment abuts on the sheet conveyance path. An adjuster adjusts the biasing force applied to the abutment situated at the abutting position.

This specification further describes an improved image forming apparatus. In one embodiment, the image forming apparatus includes an image bearer that bears an image and a transferor disposed opposite the image bearer to form a nip between the image bearer and the transferor. A sheet conveying device conveys a sheet in a sheet conveyance direction through a sheet conveyance path provided with the nip.

The sheet conveying device includes an abutment that abuts on the sheet conveyance path. A holder supports the abutment and pivots to move the abutment between an abutting position where the abutment abuts on the sheet conveyance path and a retracted position where the abutment retracts from the sheet conveyance path. A biasing member applies a biasing force to the abutment. The biasing force moves the abutment from the retracted position toward the abutting position. A restrictor restricts motion of the abutment against the biasing force at the abutting position. An adjuster adjusts the biasing force applied to the abutment situated at the abutting position.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
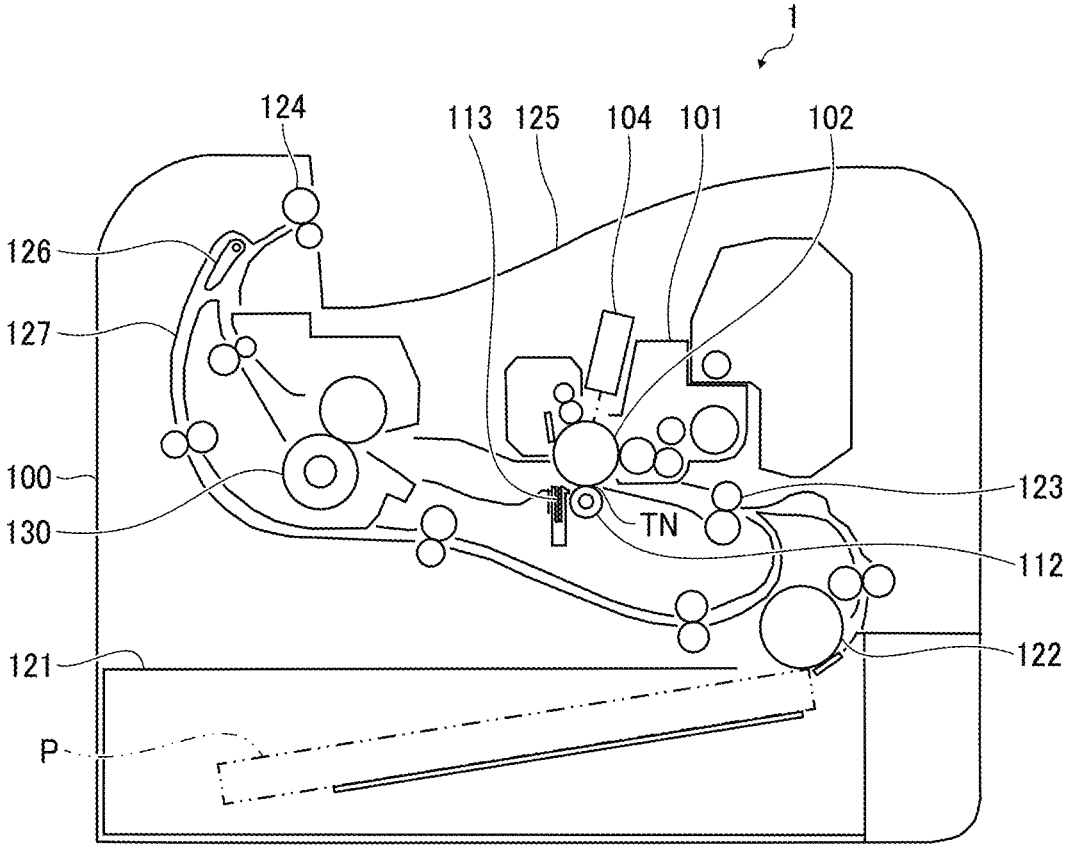
FIG. 1 is a schematic cross-sectional view of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

A description is provided of a construction of a printer 1, serving as an image forming apparatus that forms an image on a recording medium by electrophotography, according to an embodiment of the present disclosure.

FIG. 1 is a schematic cross-sectional view of the printer 1 according to this embodiment. The printer 1 is a monochrome image forming apparatus that forms a monochrome toner image on a recording medium (e.g., a sheet). A process cartridge 101 that contains black toner is removably installed in a body 100 of the printer 1. An exposure device 104, a transfer roller 112, a sheet feeding tray 121, a fixing device 130, and the like are disposed inside the body 100.

When the printer 1 receives a print job for single-sided printing, the exposure device 104 forms a latent image on a photoconductor 102 serving as an image bearer. The process cartridge 101 develops the latent image into a toner image. In a transfer process, a sheet feeding roller 122 conveys a sheet P stored in the sheet feeding tray 121 to a registration roller pair 123. The registration roller pair 123 adjusts a feeding amount of the sheet P such that a leading edge of the sheet P meets the toner image formed on the photoconductor 102 at a transfer nip TN formed between the photoconductor 102 and the transfer roller 112 serving as a transferor. As a transfer bias is applied to the transfer roller 112, the transfer roller 112 transfers the toner image formed on the photoconductor 102 onto the sheet P conveyed by the registration roller pair 123.

Since the sheet P having passed through the transfer nip TN is charged with the transfer bias, a discharging needle 113 serving as a discharger discharges static electricity from the sheet P. Accordingly, the sheet P is separated from the photoconductor 102 or the transfer roller 112 and conveyed to the fixing device 130. The fixing device 130 melts and fixes the toner image transferred onto the sheet P thereon under heat and pressure. A sheet ejecting roller 124 ejects the sheet P having passed through the fixing device 130 onto a sheet ejection tray 125 disposed outside the body 100.

When the printer 1 receives a print job for duplex printing, at a time when a trailing edge of the sheet P bearing the toner image on one side of the sheet P passes over a separation claw 126, the sheet ejecting roller 124 stops temporarily. After the separation claw 126 switches a sheet conveyance path, the sheet ejecting roller 124 rotates backward, feeding the sheet P into a duplex printing path 127. The sheet P is conveyed through the duplex printing path 127 and reaches the registration roller pair 123 again. Thereafter, a toner image is formed on another side of the sheet P through processes similar to those of single-sided printing described above.

A description is provided of a construction of a comparative image forming apparatus.

The comparative image forming apparatus includes a photoconductor and a transfer rotator that transfers a toner image formed on the photoconductor onto a sheet. The comparative image forming apparatus further includes a discharger that prevents the sheet from being attracted to the transfer rotator electrostatically. The comparative image forming apparatus further includes a mover. after the sheet contacts the discharger, the mover moves the discharger from a discharging position (e.g., an abutting position) where the discharger abuts on the sheet and discharges the sheet to a retracted position where the discharger is retracted from the sheet in accordance with motion of the sheet. That is, after the sheet comes into contact with the discharger while the sheet is conveyed, the discharger retracts from the sheet. Accordingly, when the transfer rotator transfers the toner image onto the sheet that is thick, such as a postcard or an envelope that is curled, the sheet may not be jammed. Thus, the comparative image forming apparatus may achieve stable separation and conveyance of the sheet.

However, the comparative image forming apparatus is requested to improve separation and conveyance of sheets that vary in hardness. In addition to the comparative image forming apparatus incorporating the discharger, such request is also applicable to a sheet conveying device that conveys a sheet through a sheet conveyance path. The sheet conveying device may include an abutment having a discharger that abuts on the sheet conveyance path. The sheet may come into contact with the abutment while the sheet is conveyed.

Figure 2A:
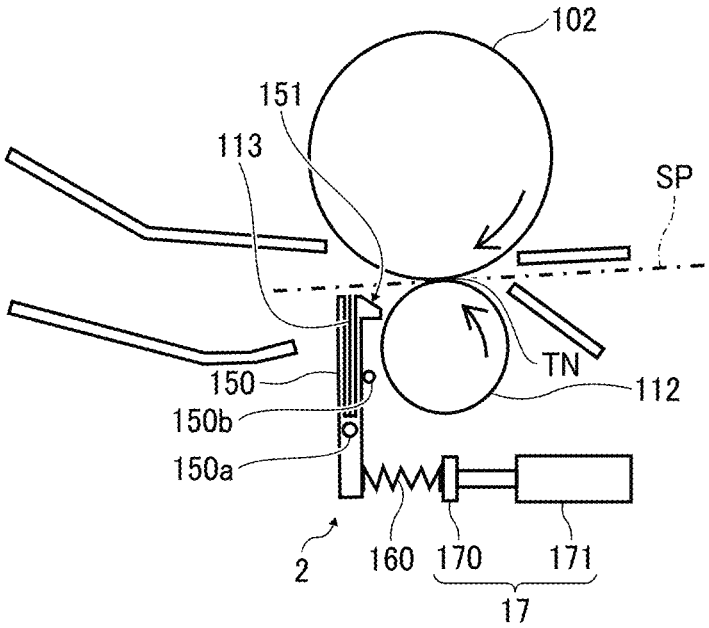
FIG. 2A is a schematic cross-sectional view of a photoconductor and a transfer roller incorporated in the printer depicted in FIG. 1, illustrating a holder that supports a discharging needle when a sheet is not conveyed through a transfer nip formed between the photoconductor and the transfer roller.
Figure 2B:
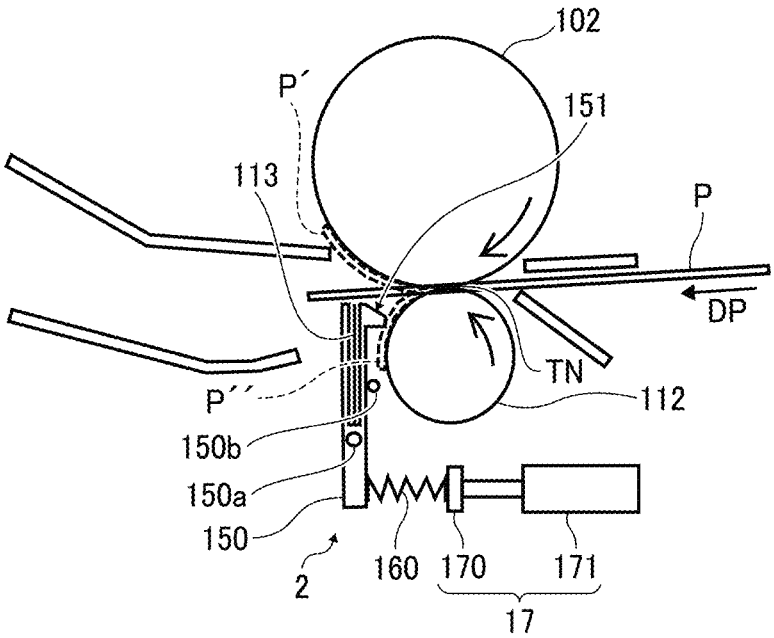
FIG. 2B is a schematic cross-sectional view of the photoconductor and the transfer roller depicted in FIG. 2A, illustrating the holder when the sheet is conveyed through the transfer nip.

FIG. 2A is a schematic cross-sectional view of the photoconductor 102 and a support mechanism that supports the discharging needle 113 when the sheet P is not conveyed through the transfer nip TN. FIG. 2B is a schematic cross-sectional view of the photoconductor 102 and the support mechanism that supports the discharging needle 113 when the sheet P is conveyed through the transfer nip TN. A holder 150 supports or holds the discharging needle 113. As illustrated in FIG. 2B, the discharging needle 113 is disposed downstream from the transfer roller 112 in a sheet conveyance direction DP. The transfer roller 112 is disposed opposite the photoconductor 102. As illustrated in FIG. 2A, the discharging needle 113 abuts on a sheet conveyance path SP and is disposed below the sheet conveyance path SP in FIG. 2A. A protective cover 151 is disposed in an upper portion of the holder 150 in FIG. 2B and disposed upstream from the discharging needle 113 in the sheet conveyance direction DP. The protective cover 151 contacts the sheet P and protects the discharging needle 113 from the sheet P. A pivot shaft 150*a* supports the holder 150 such that the holder 150 is pivotable about the pivot shaft 150*a*. A spring 160 is anchored to an opposite portion of the holder 150, which is opposite to a covered portion of the holder 150, via the pivot shaft 150*a*. The covered portion is partially covered by the protective cover 151. The spring 160 serving as a biasing member biases the holder 150 clockwise in FIGS. 2A and 2B. A positioning pin 150*b* contacts the covered portion of the holder 150 and restricts pivoting of the holder 150 against a biasing force from the spring 160. The positioning pin 150*b* serves as a restrictor that restricts pivoting of the holder 150. The spring 160 is anchored to a spring bearing 170 coupled to a driver 171 at an opposite end of the spring 160, which is opposite to a holder side end of the spring 160, which contacts the holder 150.

Regularly, the discharging needle 113 is at an abutting position depicted in FIG. 2B where the discharging needle 113 abuts on the sheet conveyance path SP from below the sheet conveyance path SP. The discharging needle 113 is disposed in proximity to a lower face of the sheet P, discharging the sheet P. Thus, the discharging needle 113 prevents the sheet P from failing to separate from the photoconductor 102 and being wound around the photoconductor 102 as illustrated as a sheet P'. The discharging needle 113 also prevents the sheet P from being wound around the transfer roller 112 with electric charge of the sheet P as illustrated as a sheet P".

Figure 3A:
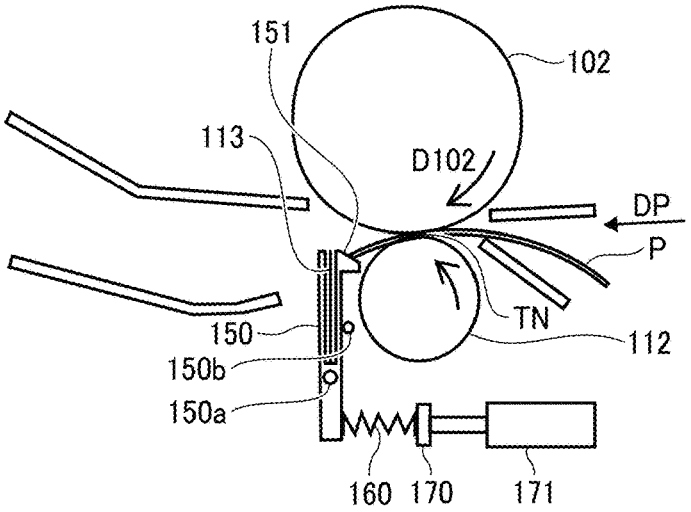
FIG. 3A is a schematic cross-sectional view of the photoconductor, the transfer roller, and a protective cover that covers the holder depicted in FIG. 2A when a leading edge of the sheet strikes the protective cover.
Figure 3B:
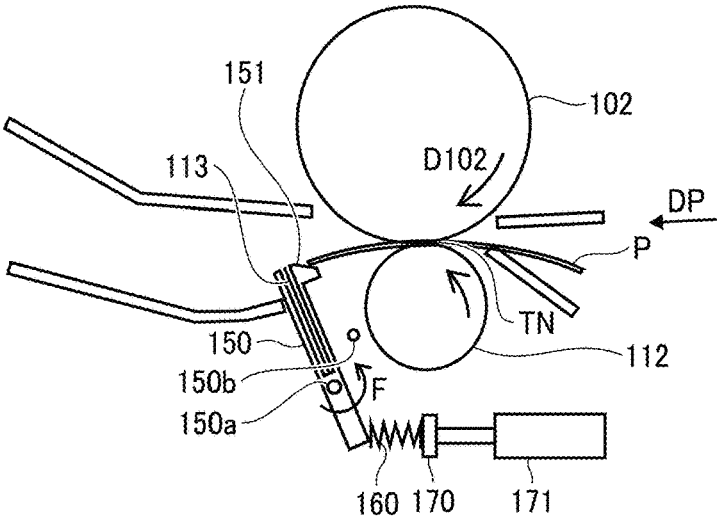
FIG. 3B is a schematic cross-sectional view of the photoconductor, the transfer roller, and the protective cover depicted in FIG. 3A when the leading edge of the sheet passes over the protective cover.
Figure 3C:
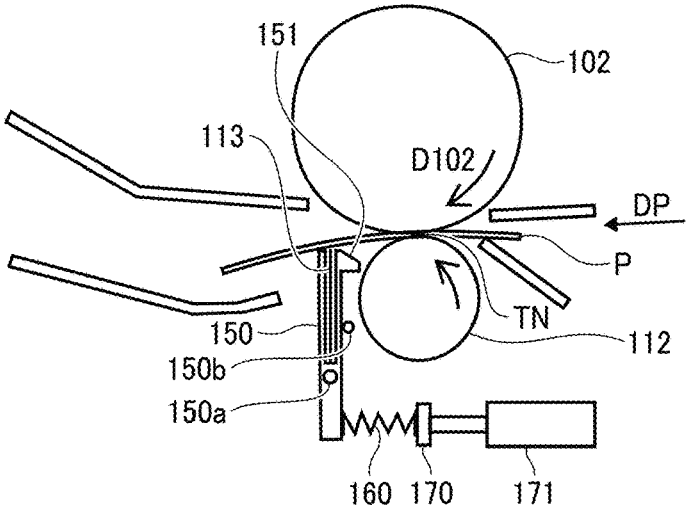
FIG. 3C is a schematic cross-sectional view of the photoconductor, the transfer roller, and the protective cover depicted in FIG. 3A when the leading edge of the sheet has passed the protective cover.

FIGS. 3A, 3B, and 3C illustrate the sheet P when the leading edge of the sheet P strikes the protective cover 151 of the holder 150. As illustrated in FIG. 3A, the sheet P is curled toward the transfer roller 112 such that the leading edge of the sheet P is directed downward. As the photoconductor 102 rotates in a rotation direction D102 and conveys the curled sheet P, the leading edge of the sheet P strikes the protective cover 151 of the holder 150. Accordingly, as illustrated in FIG. 3B, the holder 150 pivots counterclockwise in a direction F in FIG. 3B, releasing an impact to be applied to the sheet P and the holder 150. Consequently, the holder 150 prevents the sheet P from being jammed and reduces shock jitters. Thus, the holder 150 pivots and retracts to a retracted position illustrated in FIG. 3B. The sheet P is conveyed further and the leading edge of the sheet P passes the holder 150. Accordingly, as illustrated in FIG. 3C, the biasing force from the spring 160 returns the holder 150 to an original position. The holder 150 pivots as the sheet P strikes the protective cover 151 of the holder 150. Hence, the holder 150 serves as a guide that guides the discharging needle 113 that is mounted on the holder 150 and moved as the sheet P strikes the protective cover 151 of the holder 150.

Figure 4A:
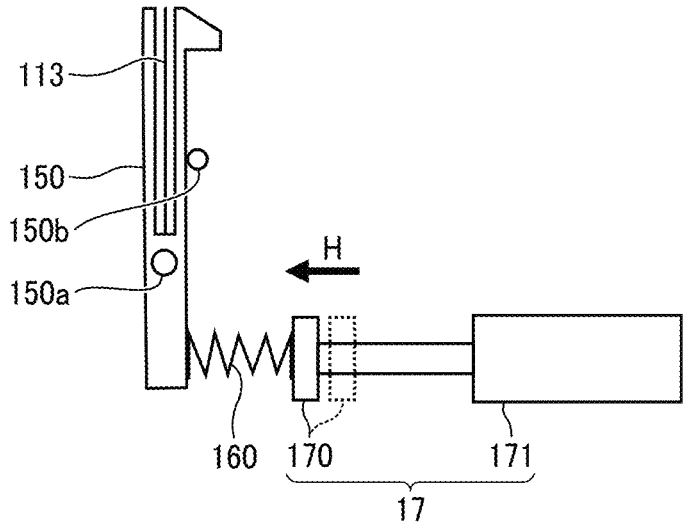
FIG. 4A is a schematic cross-sectional view of the holder depicted in FIG. 2A, illustrating a spring anchored to the holder and a driver that increases a biasing force of the spring.
Figure 4B:
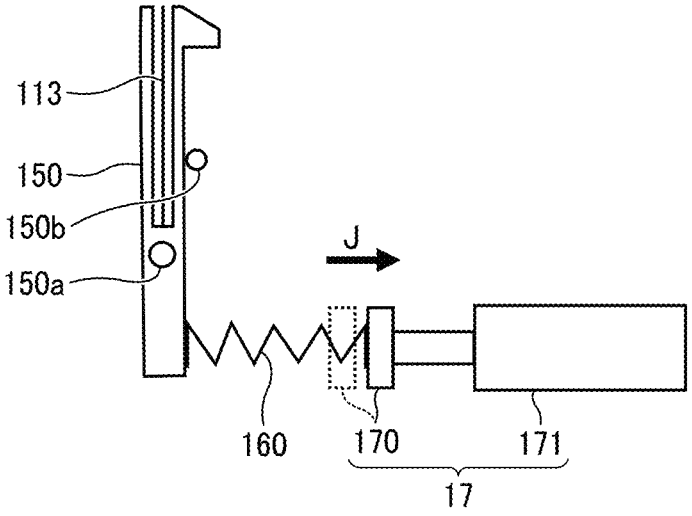
FIG. 4B is a schematic cross-sectional view of the holder depicted in FIG. 4A, illustrating the spring and the driver that decreases the biasing force of the spring.

FIGS. 4A and 4B illustrate the spring 160 of which biasing force is adjusted by the spring bearing 170 moved by the driver 171. As illustrated in FIG. 4A, as the driver 171 moves the spring bearing 170 leftward in FIG. 4A in a direction H from a position indicated with a dotted line to a position indicated with a solid line, the spring bearing 170 compresses the spring 160, increasing the biasing force generated by the spring 160. Conversely, as illustrated in FIG. 4B, as the driver 171 moves the spring bearing 170 rightward in FIG. 4B in a direction J from a position indicated with a dotted line to a position indicated with a solid line, the spring bearing 170 stretches the spring 160, decreasing spring pressure (e.g., the biasing force) generated by the spring 160. If the sheet P is thick paper, the driver 171 moves the spring bearing 170 leftward in FIG. 4A to increase the spring pressure. If the sheet P is thin paper, the driver 171 moves the spring bearing 170 rightward in FIG. 4B to decrease the spring pressure. A controller 200 depicted in FIG. 5 controls the driver 171 to move the spring bearing 170. The driver 171 includes an actuator controlled electrically. The spring bearing 170 and the driver 171 construct an adjuster 17 that adjusts the biasing force of the spring 160. The controller 200 serves as an adjuster controller that controls the adjuster 17. As illustrated in FIG. 2A, a sheet conveying device 2 includes the discharging needle 113, the holder 150, the positioning pin 150*b*, the spring 160, the spring bearing 170, and the driver 171. The sheet conveying device 2 further includes the controller 200 depicted in FIG. 5.

Figure 5:
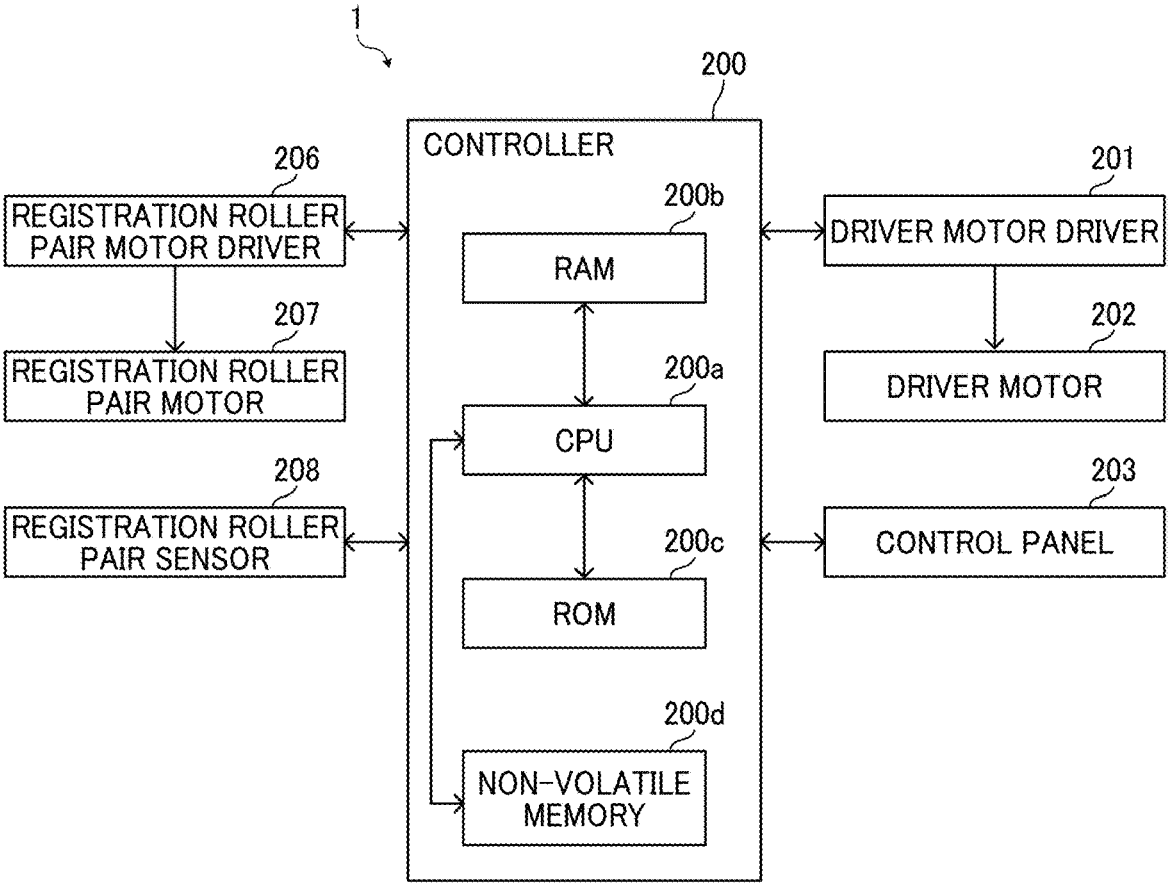
FIG. 5 is a block diagram of electrical components relating to control of the driver depicted in FIG. 4A.

FIG. 5 is a block diagram of electrical components relating to control of the driver 171. As illustrated in FIG. 5, the controller 200 controls driving of the electrical components of the printer 1 and performs predetermined arithmetic processing based on electric signals output by various sensors. The controller 200 includes a central processing unit (CPU) 200*a*, a random access memory (RAM) 200*b*, a read-only memory (ROM) 200*c*, and a non-volatile memory 200*d*. The controller 200 is electrically connected to a driver motor driver 201, a control panel 203, a registration roller pair motor driver 206, a registration roller pair sensor 208, and the like. The driver motor driver 201 drives a driver motor 202 coupled to the driver 171. The registration roller pair motor driver 206 drives a registration roller pair motor 207.

Figure 6:
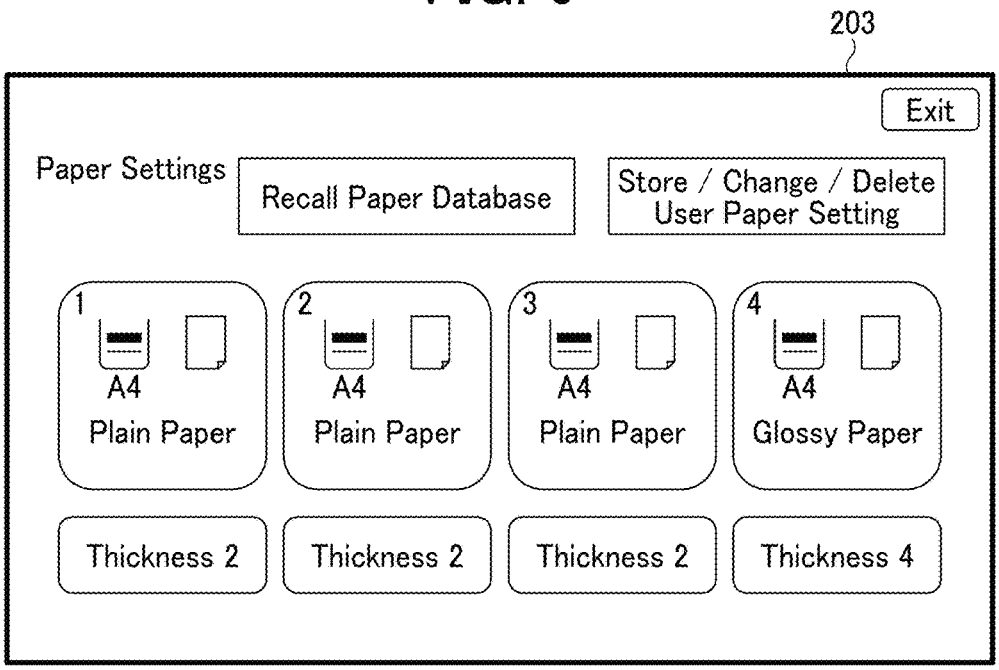
FIG. 6 is a diagram of a control panel as one of the electrical components depicted in FIG. 5, illustrating a screen on which a user performs settings for the sheet.

FIG. 6 is a diagram of the control panel 203, illustrating one example of a screen on which a user performs settings for the sheet P. A "Paper Settings" screen illustrated in FIG. 6 indicates that trays 1 to 3 load sheets P having thickness 2 in paper thickness and being classified as plain paper in paper type. The "Paper Settings" screen illustrated in FIG. 6 indicates that a tray 4 loads sheets P having thickness 4 in paper thickness and being classified as glossy paper in paper type. The "Paper Settings" screen illustrated in FIG. 6 is employed by an image forming apparatus incorporating four trays as one example. Alternatively, a similar screen on which the user selects the paper type and the paper thickness of the sheet P may be employed by an image forming apparatus incorporating a single tray like the printer 1 depicted in FIG. 1. A memory such as the non-volatile memory 200*d* depicted in FIG. 5 stores information about the paper thickness and the like of the sheets P for each tray, which is set on the "Paper Settings" screen or the like. The information about the paper thickness and the like of the sheets P is used to set conditions for transfer, fixing, and the like for printing. According to this embodiment, information about the paper thickness of the sheets P is used to control the driver 171 to adjust the spring pressure.

The driver 171 may change the spring pressure of the spring 160 while the sheet P passes over the holder 150. When the leading edge of the sheet P strikes the protective cover 151 of the holder 150, the driver 171 decreases the spring pressure. When the leading edge of the sheet P does not strike the protective cover 151 of the holder 150, the driver 171 increases the spring pressure. For example, a leading end portion of the sheet P is conveyed through an opposed position disposed opposite the discharging needle 113, serving as an abutment, situated at the abutting position where the discharging needle 113 abuts on the sheet P as illustrated in FIG. 2B in a first conveyance period. A rear portion of the sheet P, which is downstream from the leading end portion of the sheet P in the sheet conveyance direction DP, is conveyed through the opposed position in a second conveyance period. The controller 200 controls the adjuster 17 to adjust the biasing force generated by the spring 160 in the first conveyance period to be smaller than that in the second conveyance period.

Accordingly, when the leading edge of the sheet P having any paper thickness strikes the holder 150, the spring 160 retracts the holder 150 from the sheet P as illustrated in FIG. 3B. Conversely, when the rear portion of the sheet P, which is other than the leading end portion of the sheet P, contacts the holder 150, the spring 160 does not retract the holder 150 from the sheet P as illustrated in FIG. 3C. Thus, the printer 1 prevents the discharging needle 113 from suffering from discharging failure and therefore prevents the sheet P from being jammed. The controller 200 depicted in FIG. 5 also controls the driver 171 in accordance with timing of conveyance of the sheet P as described above.

FIGS. 7A, 7B, 7C, and 7D illustrate a modification example of a support mechanism that supports a holder 150S.

Figure 7A:
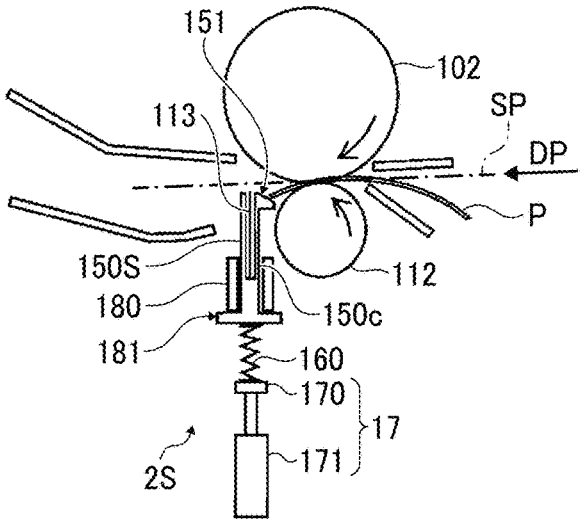
FIG. 7A is a schematic cross-sectional view of the photoconductor, the transfer roller, and a holder as a modification example of the holder depicted in FIG. 2A, illustrating a state in which a leading edge of a sheet curled toward the transfer roller contacts the holder.
Figure 7B:
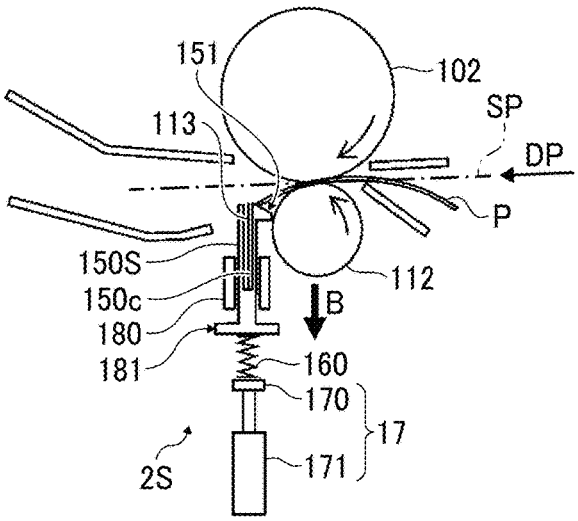
FIG. 7B is a schematic cross-sectional view of the photoconductor, the transfer roller, and the holder depicted in FIG. 7A, illustrating a state in which the leading edge of the sheet presses down the holder.

As illustrated in FIGS. 7A and 7B, a sheet conveying device 2S includes the discharging needle 113, the holder 150S, the spring 160, and the adjuster 17.

Figure 7C:
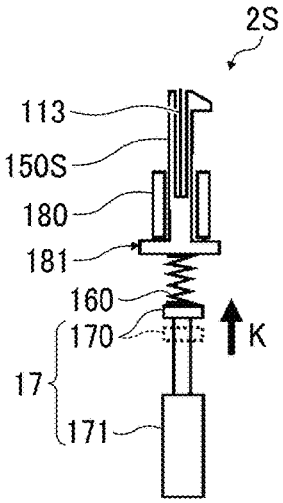
FIG. 7C is a schematic cross-sectional view of a sheet conveying device incorporating the holder depicted in FIG. 7A, illustrating a state in which the driver increases spring pressure of the spring.
Figure 7D:
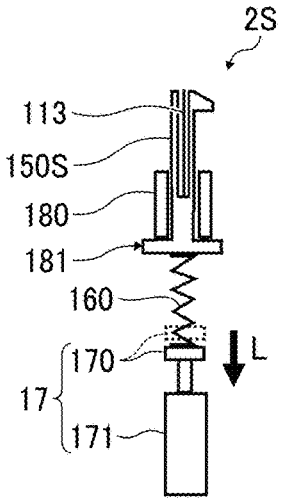
FIG. 7D is a schematic cross-sectional view of the sheet conveying device depicted in FIG. 7C, illustrating a state in which the driver decreases the spring pressure of the spring.

The support mechanism supports the holder 150S in a direction perpendicular to the sheet conveyance path SP (e.g., the sheet conveyance direction DP) such that the holder 150S retracts from the sheet P in the direction perpendicular to the sheet conveyance path SP. The support mechanism includes a guide 180 and the spring 160. The guide 180 guides a slide portion 150*c* of the holder 150S, which slides over the guide 180. The spring 160 is anchored to a base 181 that is combined with a lower end portion of the holder 150S. The spring 160 presses the base 181 upward in FIG. 7A toward the sheet conveyance path SP. The support mechanism further includes the driver 171 that moves the spring bearing 170 upward and downward in FIG. 7A. A lower end of the spring 160 is anchored to the spring bearing 170. FIG. 7A illustrates a state in which the leading edge of the sheet P curled toward the transfer roller 112 contacts the protective cover 151. FIG. 7B illustrates a state in which the leading edge of the sheet P presses down the holder 150S in a direction B. As the sheet P is conveyed further, the leading edge of the sheet P separates from the protective cover 151 and the holder 150S is lifted. FIG. 7C illustrates a state in which the driver 171 lifts the spring bearing 170 in a direction K to increase the spring pressure. Conversely, FIG. 7D illustrates a state in which the driver 171 lowers the spring bearing 170 in a direction L to decrease the spring pressure.

According to the embodiment described above with reference to FIGS. 2A, 2B, 3A, 3B, and 3C, the holder 150 is pivotable and disposed downstream from the transfer roller 112 in the sheet conveyance direction DP. The controller 200 depicted in FIG. 5 controls the driver 171 to change the spring pressure of the spring 160 that biases the holder 150 toward the transfer roller 112. The controller 200 controls the driver 171 to increase the spring pressure when the sheet P is thick paper. The controller 200 controls the driver 171 to decrease the spring pressure when the sheet P is thin paper. Thus, the controller 200 adjusts a retracting force that retracts the holder 150 from the sheet P when the leading edge of the sheet P strikes the holder 150 according to the thickness of the sheet P. Accordingly, the controller 200 prevents the holder 150 from pivoting accidentally, preventing the sheet P from being jammed and reducing shock jitters regardless of the thickness of the sheet P.

According to the embodiments described above, the driver 171 including the actuator controlled electrically adjusts the biasing force (e.g., the spring pressure) of the spring 160. Instead of the driver 171 or in addition to the driver 171, adjustment of the spring pressure of the spring 160 according to the thickness of the sheet P may be performed with a control portion such as a manual lever.

The embodiments described above are applied to the printer 1 as a monochrome image forming apparatus in which the sheet P is conveyed horizontally as one example. The embodiments described above are also applicable to a color image forming apparatus that forms a color toner image, an image forming apparatus in which the sheet P is conveyed vertically, and the like.

The embodiments described above employ the discharging needle 113 as an abutment. Alternatively, the embodiments described above may be applied to a device that includes an abutment, a holder, a biasing member, and a restrictor. The holder supports the abutment such that the abutment moves between an abutting position where the abutment abuts on a sheet conveyance path and a retracted position where the abutment retracts from the sheet conveyance path. The biasing member biases the abutment to move from the retracted position toward the abutting position. The restrictor restricts motion of the abutment against a biasing force from the biasing member at the abutting position.

A description is provided of advantages of a sheet conveying device (e.g., the sheet conveying device 2).

As illustrated in FIGS. 2A, 2B, 3A, 3B, 3C, 4A, and 4B, the sheet conveying device includes an abutment (e.g., the discharging needle 113), a holder (e.g., the holder 150), a biasing member (e.g., the spring 160), a restrictor (e.g., the positioning pin 150*b*), and an adjuster (e.g., the adjuster 17).

The abutment abuts on a sheet conveyance path (e.g., the sheet conveyance path SP) through which a sheet (e.g., the sheet P) is conveyed. The holder supports the abutment and pivots to move the abutment between an abutting position where the abutment abuts on the sheet conveyance path and a retracted position where the abutment retracts from the sheet conveyance path. The biasing member applies a biasing force to the abutment, that moves the abutment from the retracted position toward the abutting position. The restrictor restricts motion of the abutment against the biasing force from the biasing member at the abutting position. The adjuster adjusts the biasing force of the biasing member, that is applied to the abutment situated at a predetermined position inside the sheet conveying device as the abutting position.

Accordingly, the sheet conveying device improves conveyance of sheets that vary in hardness.

According to the embodiments described above, the printer 1 serves as an image forming apparatus. Alternatively, the image forming apparatus may be a copier, a facsimile machine, a multifunction peripheral (MFP) having at least two of printing, copying, facsimile, scanning, and plotter functions, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet conveying device comprising:

an abutment to abut on a sheet conveyance path through which a sheet is conveyed;

a holder to support the abutment and pivot to move the abutment between an abutting position where the abutment abuts on the sheet conveyance path and a retracted position where the abutment retracts from the sheet conveyance path;

a biasing structure to apply a biasing force to the abutment, wherein the biasing force moves the abutment from the retracted position toward the abutting position;

a restrictor to restrict motion of the abutment against the biasing force at the abutting position; and an adjuster to adjust the biasing force applied to the abutment situated at the abutting position, wherein the adjuster includes an actuator.

2. The sheet conveying device according to claim 1, wherein the biasing structure is anchored to the holder.

3. The sheet conveying device according to claim 1, wherein the retracted position is disposed downstream from the abutting position in a sheet conveyance direction.

4. The sheet conveying device according to claim 1, further comprising a controller to control the actuator electrically.

5. The sheet conveying device according to claim 4, further comprising a control panel connected to the controller to receive information about a thickness of the sheet.

6. The sheet conveying device according to claim 5, wherein the controller is configured to control the actuator to adjust the biasing force based on the thickness of the sheet.

7. The sheet conveying device according to claim 4, wherein a leading end portion of the sheet is conveyed through an opposed position disposed opposite the abutment situated at the abutting position in a first conveyance period, wherein a rear portion of the sheet, the rear portion disposed downstream from the leading end portion of the sheet in a sheet conveyance direction, is conveyed through the opposed position in a second conveyance period, and wherein the controller is configured to control the actuator to adjust the biasing force to be smaller in the first conveyance period than in the second conveyance period.

8. The sheet conveying device according to claim 1, wherein the biasing structure includes a spring.

9. The sheet conveying device according to claim 8, wherein the adjuster further includes a spring bearing anchored with the spring and coupled to the actuator.

10. The sheet conveying device according to claim 1, wherein the abutment includes a discharging needle to discharge static electricity from the sheet.

11. The sheet conveying device according to claim 1, wherein the restrictor includes a positioning pin to restrict pivoting of the holder against the biasing force.

12. A sheet conveying device comprising:

an abutment to abut on a sheet conveyance path through which a sheet is conveyed;

a holder to support the abutment;

a biasing structure to apply a biasing force to the abutment, wherein the biasing force moves the abutment toward an abutting position where the abutment abuts on the sheet conveyance path; and an adjuster to adjust the biasing force applied to the abutment situated at the abutting position, wherein the adjuster includes an actuator.

13. The sheet conveying device according to claim 12, further comprising:

a base combined with the holder and anchored with the biasing structure; and a guide to guide the holder.

14. An image forming apparatus comprising:

an image bearer to bear an image;

a transferor disposed opposite the image bearer to form a nip between the image bearer and the transferor; and a sheet conveyor to convey a sheet in a sheet conveyance direction through a sheet conveyance path provided with the nip, the sheet conveyor including:

an abutment to abut on the sheet conveyance path;

a holder to support the abutment and pivot to move the abutment between an abutting position where the abutment abuts on the sheet conveyance path and a retracted position where the abutment retracts from the sheet conveyance path;

a biasing structure to apply a biasing force to the abutment, wherein the biasing force moves the abutment from the retracted position toward the abutting position;

a restrictor to restrict motion of the abutment against the biasing force at the abutting position; and an adjuster to adjust the biasing force applied to the abutment situated at the abutting position.

15. The image forming apparatus according to claim 14, wherein the abutment includes a discharger disposed downstream from the transferor in the sheet conveyance direction to discharge static electricity from the sheet.

16. The image forming apparatus according to claim 15, wherein the holder includes a protective cover disposed upstream from the discharger in the sheet conveyance direction to cover the discharger.

* * * * *